US011179827B1

(12) United States Patent
Lambrinos

(10) Patent No.: US 11,179,827 B1
(45) Date of Patent: Nov. 23, 2021

(54) SAFETY COMMUNICATION SYSTEM FOR REMOTE SANDBLASTING OPERATIONS

(71) Applicant: Jon Lambrinos, Campbell, OH (US)

(72) Inventor: Jon Lambrinos, Campbell, OH (US)

( * ) Notice: Subject to any disclaimer, the term of this patent is extended or adjusted under 35 U.S.C. 154(b) by 688 days.

(21) Appl. No.: 16/110,199

(22) Filed: Aug. 23, 2018

Related U.S. Application Data

(60) Provisional application No. 62/588,531, filed on Nov. 20, 2017.

(51) Int. Cl.

| | |
|---|---|
| ***B24C 3/02*** | (2006.01) |
| ***B24C 5/02*** | (2006.01) |
| ***B24C 9/00*** | (2006.01) |
| ***G08B 7/06*** | (2006.01) |
| ***B24C 7/00*** | (2006.01) |
| ***B24C 3/06*** | (2006.01) |

(52) U.S. Cl.
CPC ..... *B24C 9/00* (2013.01); *B24C 3/02* (2013.01); *B24C 3/06* (2013.01); *B24C 5/02* (2013.01); *B24C 7/0046* (2013.01); *G08B 7/06* (2013.01)

(58) Field of Classification Search
CPC .... B24C 3/02; B24C 3/06; B24C 5/02; B24C 5/04; B24C 7/0046; B24C 7/0053; B24C 9/00; G08B 7/06
USPC ..... 451/2, 38, 90, 102
See application file for complete search history.

(56) References Cited

U.S. PATENT DOCUMENTS

| | | | | |
|---|---|---|---|---|
| 5,097,633 A * | 3/1992 | Branton | B24C 7/0053 | 451/101 |
| 5,176,018 A * | 1/1993 | Thompson | G01P 11/00 | 72/53 |
| 5,216,848 A * | 6/1993 | Abbott | B24C 5/02 | 451/2 |
| 5,637,027 A * | 6/1997 | Palombo | B05B 12/004 | 134/11 |
| 6,932,670 B1 * | 8/2005 | Lambrinos | B24C 3/00 | 451/2 |

* cited by examiner

*Primary Examiner* — Eileen P Morgan
(74) *Attorney, Agent, or Firm* — Harpman & Harpman

(57) ABSTRACT

An independent safety warning and notification system for sandblasting operations that require an operator of a blasting hose to be remotely positioned to the blasting pot operator. A dedicated activation switch assembly is secured to an existing sandblast hose with a separate dead man switch or alternately with an integrated dead man switch allowing the blast nozzle operator to communicate critical information to the pot operator. A warning notification light display and audible alarm assembly with a remotely positional warning light alarm is selectively secured near the pot operator for notification that a prescribed predetermined action has been requested by the blast nozzle operator or an emergency situation by activation of the switch assembly.

11 Claims, 8 Drawing Sheets

SAFETY COMMUNICATION SYSTEM FOR REMOTE SANDBLASTING OPERATIONS

The application claims the benefit of U.S. Provisional Application No. 62/588,531, filed Nov. 20, 2017.

BACKGROUND OF THE INVENTION

1. Technical Field

This device relates to sandblasting operators wherein an abrasive is discharged from a sandblasting gun or nozzle against a surface to be cleaned. A supply of abrasive is held in a "pot" and supplied with a source of compressed air. The system supplies the abrasive entrained in an airstream to a discharge blast nozzle controlled by an operator. Typically, the blast nozzle operator is at a remote distance to the "pot" or machine operator who is responsible for control of the pot operation. Given the distance and the associated noise of the blasting environment, it is often difficult if not impossible for the nozzle operator to communicate with the pot or machine operator and often the nozzle operator is out of the visual and audio of the operator making direct communication almost impossible.

2. Description of Prior Art

Prior art communication in remote control devices has been developed to assist the nozzle operator in communicating and limited remote control. See for example, applicant's U.S. Pat. No. 6,932,670 directed to a signaling system for sandblasting having a two-position switch with a blast nozzle operator that illuminates the respective light display from two positions and audible alarm alerting the pot operator that a prescribed action needs to be taken.

A dead man switch is also available and shown in prior art in which a switch position must be maintained to operate the system and in some applications a separate switch is added to signal control from the pot, similar to the control notification sequence illustrated in the above referred to U.S. Pat. No. 6,932,670.

SUMMARY OF THE INVENTION

A self-contained portable warning and alarm system for use in sandblasting operations. The warning and alarm system utilizes independent activation switch buttons secured to the blasting supply hose near the blasting nozzle or to an existing dead man switch and an interconnected warning light and audible alarm display remotely positioned near the supply pot and machine operator. The system of the invention may be self-powered and is adaptable for ease of installation on a variety of existing nozzle supply hose and dead man switch blasting systems repositionably attached on or near the supply pot or machines and the operator. A button activation sequence determines required action and effective communication between the blast nozzle operator and the pot or machine operator which can be determined and preprogrammed by a circuit controller.

DETAILED DESCRIPTION OF THE INVENTION

Figure 1:
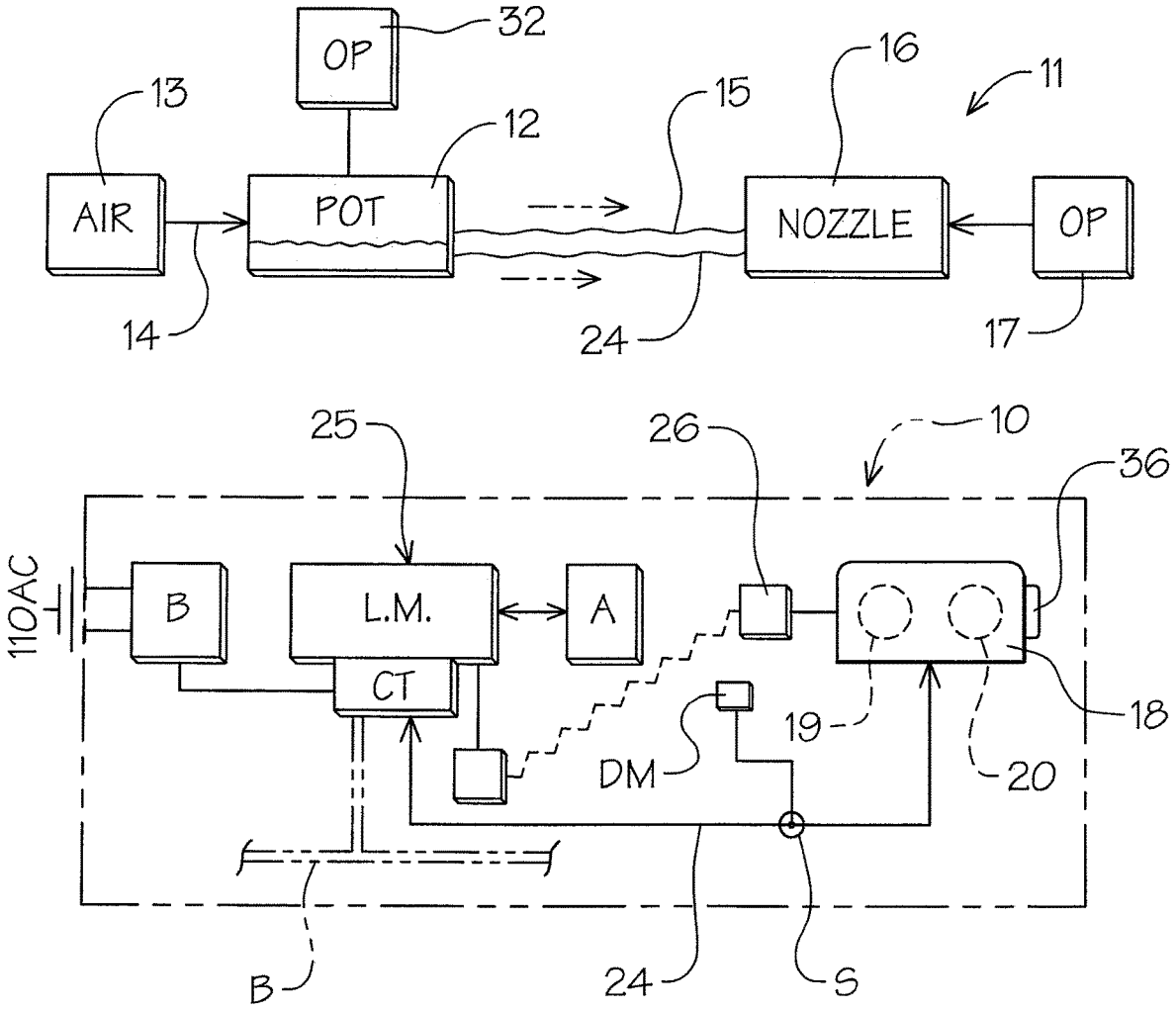
FIG. 1 is a block flow diagram illustrating the signaling system device of the invention.

Referring to FIG. 1 of the drawings, a safety communication system 10 of the invention for a sandblasting assembly 11 can be seen delineated by the inclusive broken lines. The sandblasting assembly 11 has a sandblasting abrasive dispensing pot 12 with a supply of compressed air 13 to a blast nozzle supply hose 15 that is in communication with a sandblasting outlet nozzle 16.

In operation, abrasive material M, such as sand, within the pot 12 is mixed with the compressed air 14 and transported through the blast nozzle supply hose 15 to the outlet nozzle 16 which is controlled and used by the nozzle operator 17.

Figure 2:
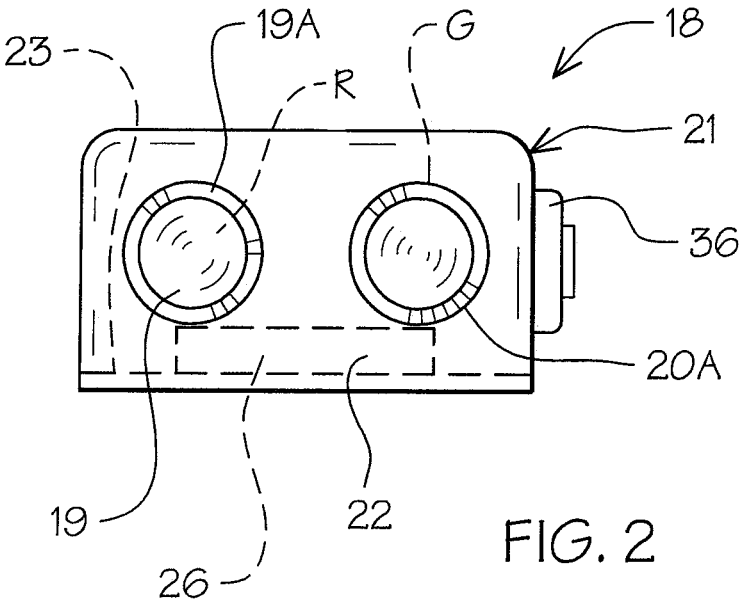
FIG. 2 is a front elevational view of a nozzle operator activating switch assembly example.
Figure 3:
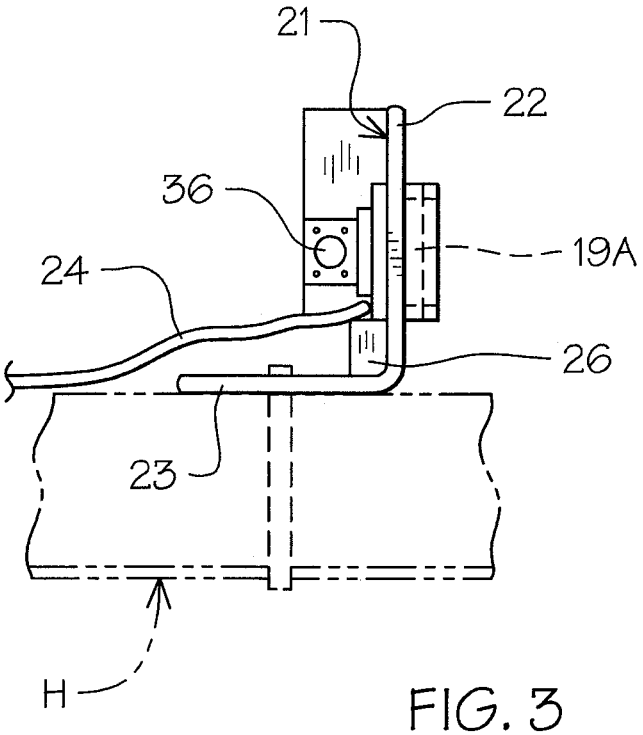
FIG. 3 is a side elevational view thereof.

The safety communication system 10 of the invention has a control activation switch assembly 18, as best seen in FIGS. 2 and 3 of the drawings. The activation switch assembly 18 has a pair of general activation buttons 19 and 20 each of which, in this example, is designated by a prescribed color (red) 19 and (green) 20 and an emergency kill button 36.

The buttons 19 and 20 are mounted on a support bracket 21 with each of the buttons having an integrated annular upstanding ring 19A and 20A which prevents accidental activation as is well known within the industrial art.

The support bracket 21, in this example, is of an L-shaped configuration with an upstanding button mounting portion 22 and a hose engagement portion 23 extending at right angles thereto that can conform to fit a variety of blasting nozzles/hose H configurations found within the industry shown generally in broken lines for illustration purposes only adjacent the blast nozzle 16.

Figure 4:
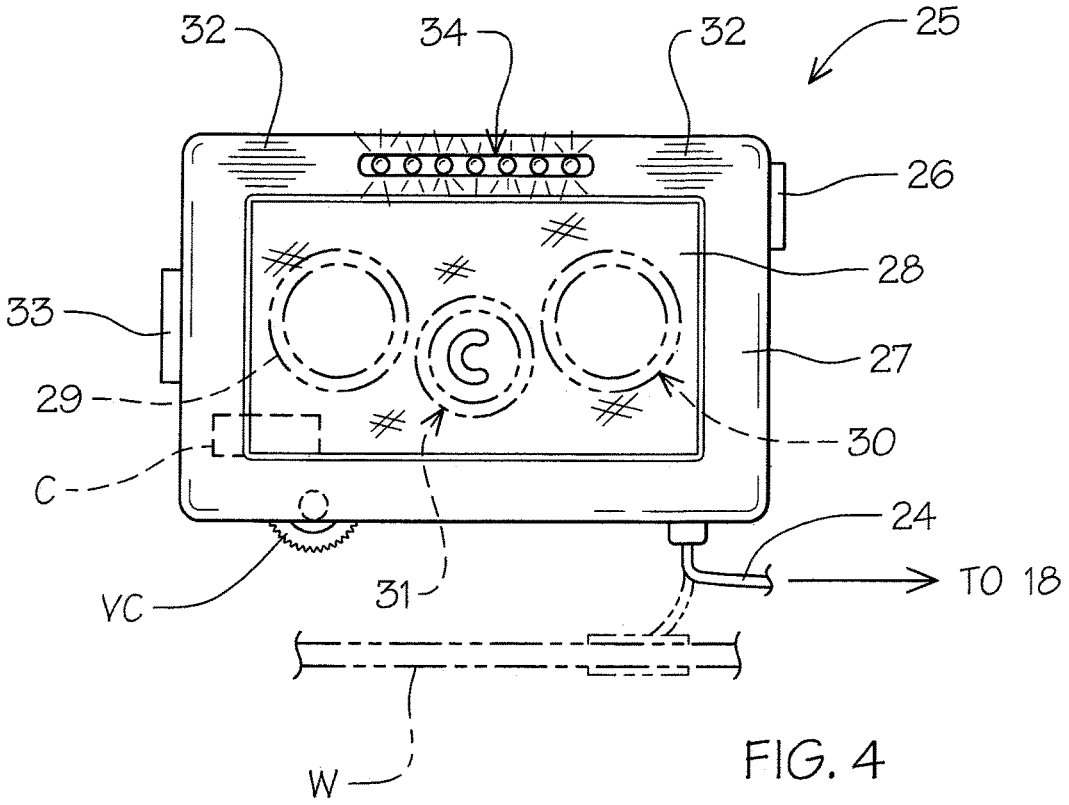
FIG. 4 is a front elevational view of an example signal light and alarm notification unit for the pot operator.
Figure 5:
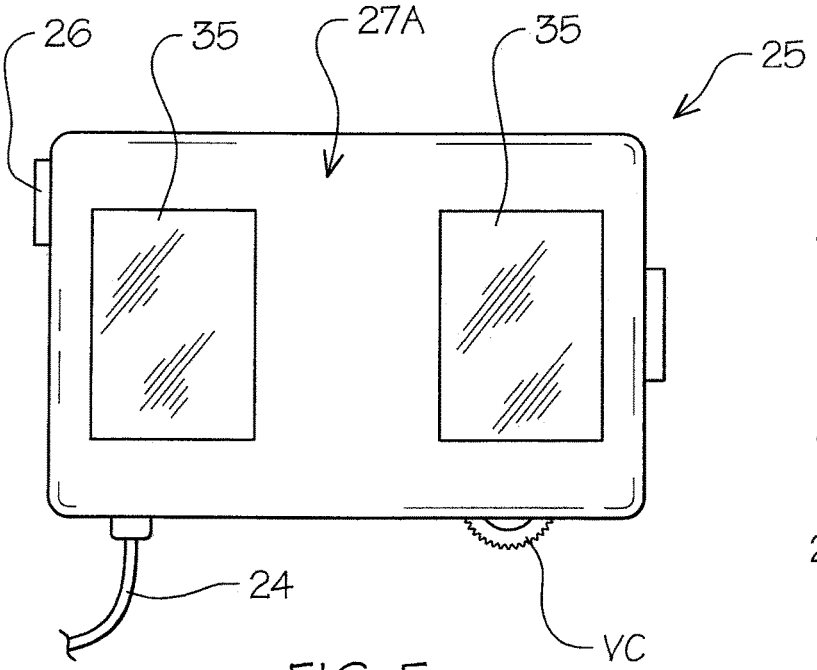
FIG. 5 is a rear elevational view thereof.
Figure 6:
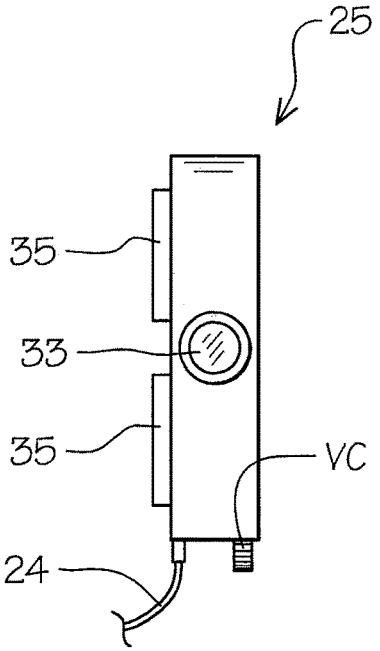
FIG. 6 is a left side elevational view thereof.

A communication cable 24 extends from the switch assembly 18 back to a signal light and audible alarm display module 25, best seen in FIGS. 1, 4 and 5 of the drawings. Alternately, a wireless receiver module 26 will provide wireless communication with the signal and alarm module 25 as will be described hereinafter.

The signal light alarm display 25 has a rectangular housing 27 with a liquid crystal display (LCD) display screen 28 mounted within. In this application, LCD 28 will display multiple action symbols 29 and 30 colored red and green respectively to correspond to the selected colors of the buttons 19 and 20, noted above. An operator "choke" symbol 31 is also selectively displayed as required. An integrated speaker 32 within the display housing 27 provides and audible tone when a signal is detected, and a volume control VC as discussed hereinafter. A reset/confirmation activation switch 33 extends from the housing 27 and a flashing notification light 34 is provided for confirmation to the nozzle operator 17.

In this primary example, chosen for illustration, a pair of mounting magnets 35 are positioned on the reverse side 27A of the housing to provide select magnetic placement thereof on any metallic surface of sandblasting equipment adjacent to or on the pot 12.

The communication cable 24 will follow, and is removably attached, to the blast nozzle supply hose 15 as required in the application operational installation of the system. Alternately, the safety communication system 10 can use an existing multi-feed operations wire W shown in broken lines enabling a pair of unused wires there within. The display module 25 and the switch assembly 18 is enabled with wireless communication protocol circuit wherein a wi-fi transmitter/receiver is provided so that a wireless data communication link can be established including a smart phone app, if required, to monitor the system from an offsite location.

In operation, the preferred operational sequence for the nozzle operator 17 to communicate with a pot machine operator 32 is by pushing the red button 19 or green button 20 on the switch assembly 18 as follows.

In order to generate a signal, the activation buttons 19 and 20 independently or together must be pushed and hold for three seconds before it will activate the circuit for LCD and illumination and, if required, audible alarms 32 and blinking screen light corresponding to the button pushed. To achieve same, a circuit controller C is integrated into the light and audible alarm display module 25 and is programmable to determine the operational button sequence required for the variety of notifications available within the system. For example, a specific pot operation typically required in the industry is referred to as a "choke" which refers to the pot operator holding or stopping airflow to build up pressure then release as may be required during use. Other actions for adjusting the supply of abrasive material M to the blast nozzle 16. To initiate a "choke" request, the nozzle operator 17 pushes both buttons 19 and 20 back and forth or three seconds. The corresponding action is identified on the LCD "choke" and blinks until pot operator 32 confirms.

Another example is to raise or lower the material flow by activation for three seconds of the red button to lower and correspondingly the green button to raise material flow. To activate an emergency notification by the nozzle operator 17 which in this example it is required to hold both activation buttons 19 and 20 simultaneously for a minimum of three seconds indicating that an emergency has occurred. Additionally, the operator emergency "kill button" 36 is provided which will quickly indicate a wrong or unwanted action has been taken by the pot operator 32.

In response to button sequence activation, according to the programmed controller of the circuit C, the emergency light and audible alarm speaker 32 will sound on the action alarm display module 25. In either case, as noted, a reset or acknowledgement signal must be instituted by the pot operator 17 to confirm that the notification of the alarm or light sequence has been achieved and to reset the system via a control reset button 33 on the display module which will be confirmed on the switch 18.

It will be evident therefore that the number of activation and notification illuminated warning symbols 19 and 20 may be modified depending on the programmable controller C given the use venue and job operational needs for particular applications.

A power source is provided which in this illustration is a 110V AC in communication with the display module 25 and correspondingly the blast operator switch assembly 18, alternately, a battery B may be used as a backup power.

It will also be evident that a variety of attachment methodology may be used for securing the support bracket 21 of the activation switch assembly 18 without departing from the scope of the invention.

The safety communication system 10 of the invention will therefore provide a simple low cost, portable notification system that will selectively provide communication from the nozzle operator 17 to the pot machine operator 32 utilizing both audible alarm light and symbol illumination sequences that will determine the nature of the information notification, the required action by the pot machine operator in response to the remote nozzle operator's request and confirmation that the notification has been received.

Figure 7:
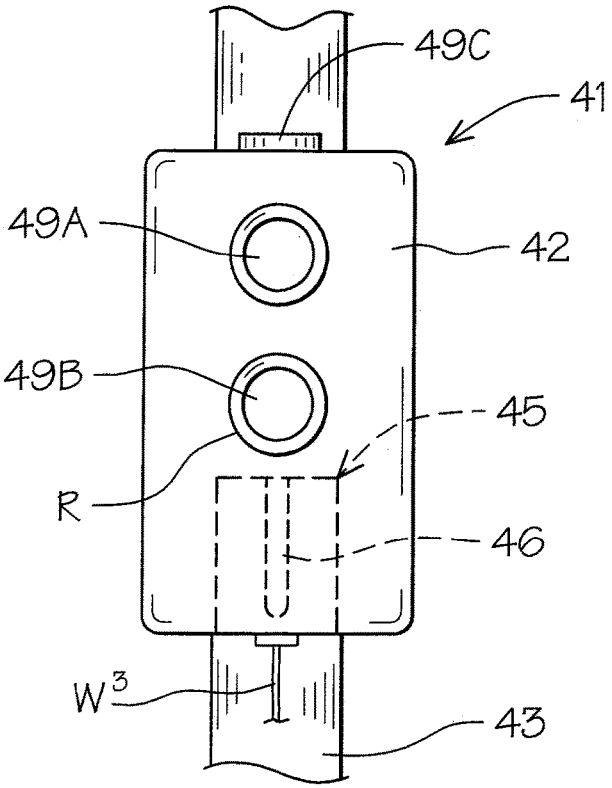
FIG. 7 is a front elevational view of a first alternate nozzle operator activating switch assembly.
Figure 8:
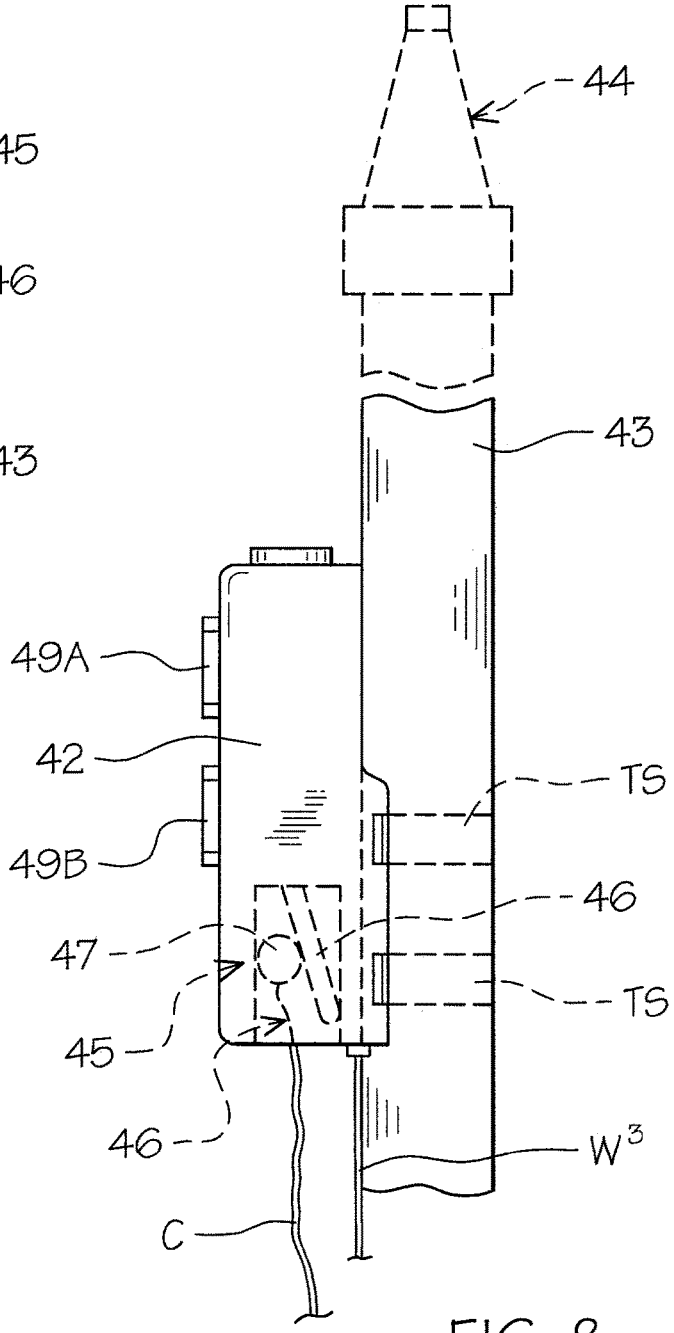
FIG. 8 is a side elevational view thereof.

Referring now to FIGS. 7 and 8 of the drawings, a first alternate safety communication system for remote sandblasting 40 can be seen having an alternate remote-control signal activation switch 41.

Signal activation switch 41, with a multiple wire configuration, has a main housing 42 that will be selectively secured to a sandblast nozzle supply hose 43 adjacent a blast nozzle 44 as shown graphically in broken lines.

The signal switch 41 has a dead man's switch 45 that provides a safety user fail safe configuration, well known and understood within the art, positioned within a hooded enclosure area 46. This orientation allows for the use of a switch retainment insert 47, typically having a flexible cord or chain C that is designed to be secured to the operator 48. In operation, the dead man switch 45 can provide control by air and sand in up position and just air in down position with center dead man completely off.

The signal switch 41, housing 42 has a pair of signal activation buttons 49A and 49B on its upper surface, best seen in FIG. 7 of the drawings. Each button is surrounded by an upstanding annular ring R so as to prevent accidental activation by the blast nozzle operator 48 illustrated graphically in FIG. 9 of the drawings.

The button signal sequence illustrated by button 49A "more sand", button 49B "less sand". These requests are typical within the requirement of nozzle operator requests to increase or decrease the flow of abrasive material, such as sand.

Figure 12:
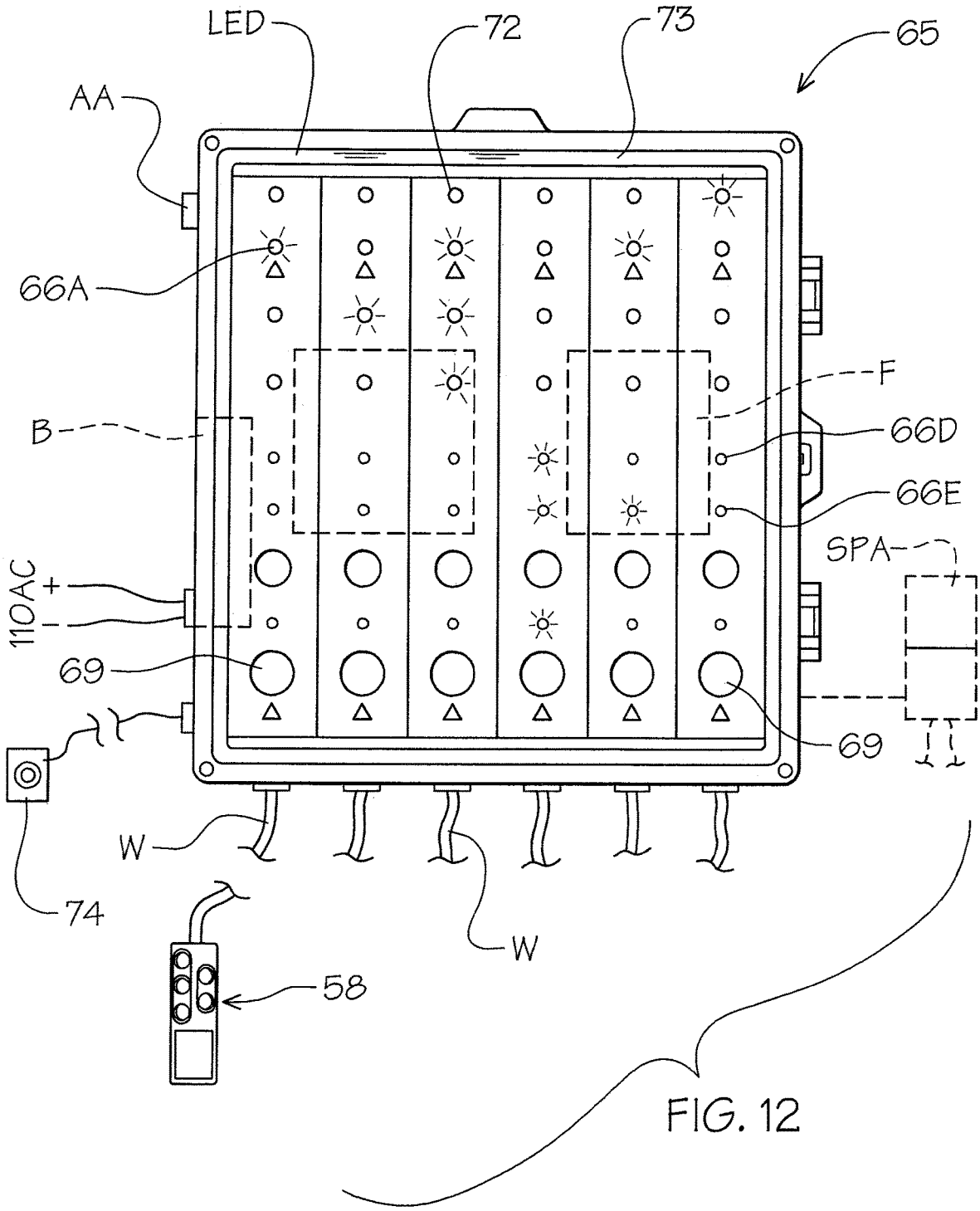
FIG. 12 is a front elevational view of a primary signal alarm notification unit.

This orientation allows the nozzle operator to signal the blast pot equipment operator as to his current requested requirements which are illuminated and displayed on a multiple blast input signal display board 65 as seen in FIG. 12 of the drawings and will be described in greater detail hereinafter.

The signal switch 41 also has an emergency button 49C positioned on the housing end surface 41A as seen in FIGS. 7 and 8 of the drawings which will be discussed in detail hereinafter.

Figure 9:
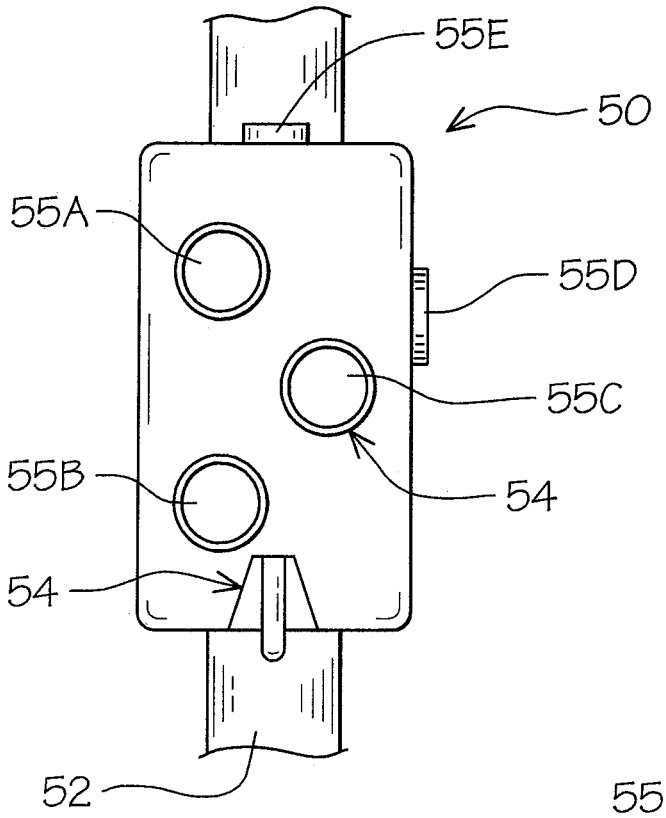
FIG. 9 is a front elevational view of a second alternate nozzle operator activating switch assembly.
Figure 10:
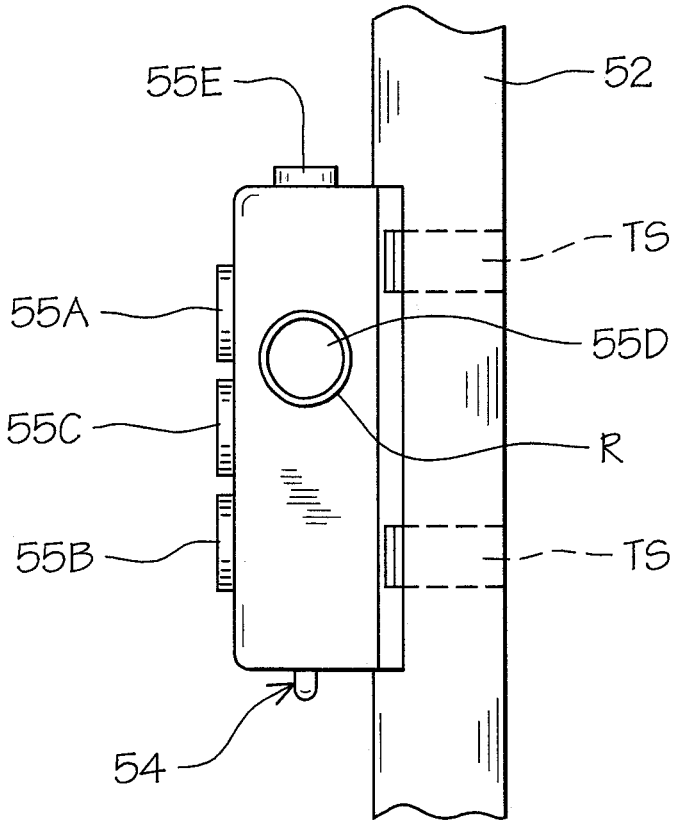
FIG. 10 is a side elevational view thereof.

Referring now to FIGS. 9 and 10 of the drawings, a second alternate safety communication system for remote sandblasting can be seen having an alternate remote-control signal activation switch 50.

Figure 11:
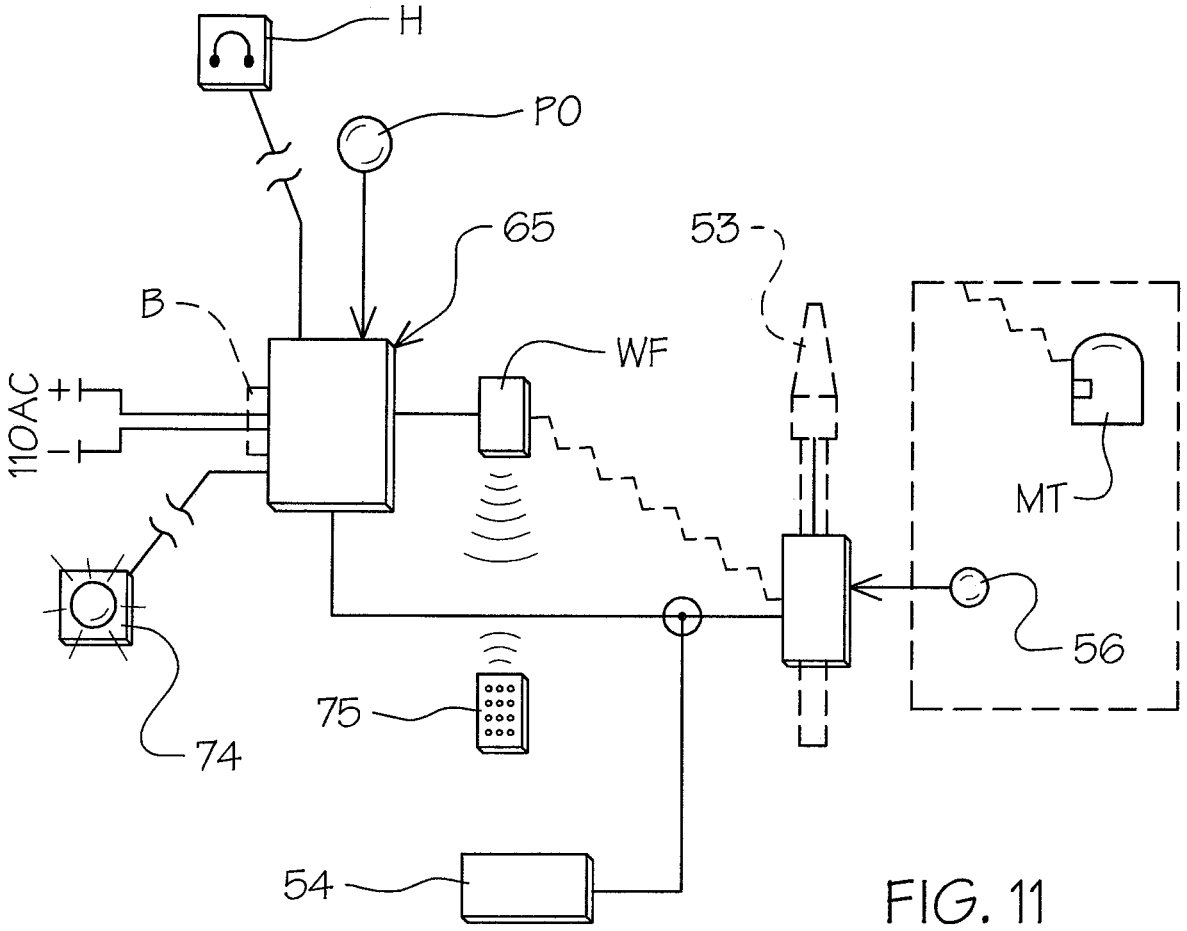
FIG. 11 is a block flow diagram illustrating the signal system.

The signal activation switch 50 has a main housing 51 that will be selectively secured to a sandblast nozzle supply hose 52 adjacent a blast nozzle 53, as shown graphically in FIG. 11 of the drawings.

The signal switch 50 combines a dead man's switch 54 that provides a safety user fail safe configuration, well known and understood within the art, with the remote notification switch configuration, as hereinbefore described.

The second alternate signal switch 50 has multiple signal activation buttons 55 on its upper surface 56, best seen in FIG. 9 of the drawings. Each button is surrounded by an upstanding annular ring R so as to prevent accidental activation by a blast nozzle operator 56, illustrated graphically in FIG. 11 of the drawings.

The buttons 55 on the upper surface 56 have a button signal sequence illustrated by button 55A, more sand, button 55B, less sand, and button 55C, choke. These requests are typical within the requirement of nozzle operator requests to increase or decrease the flow of abrasive material such as sand and also the operation of the feature of the choke associated with the blast nozzle operation requirements as previously described.

The second alternate signal switch 50 also has a "air only" signal button 55D positioned on the side surface as seen in FIG. 10 of the drawings and an emergency button 55E on the top end surface.

Figure 14:
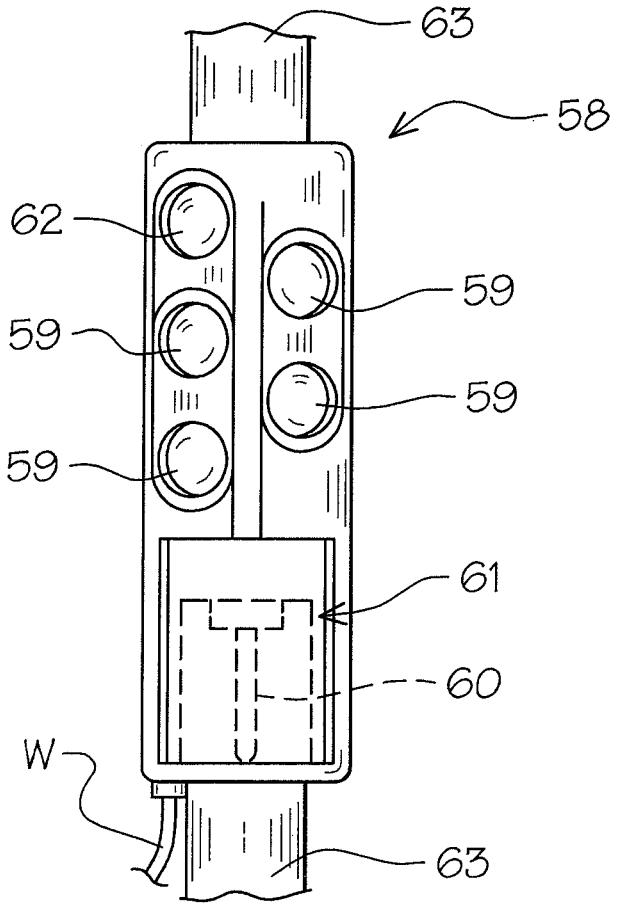
FIG. 14 is a front elevational view of a third alternate nozzle operator activating switch assembly.
Figure 15:
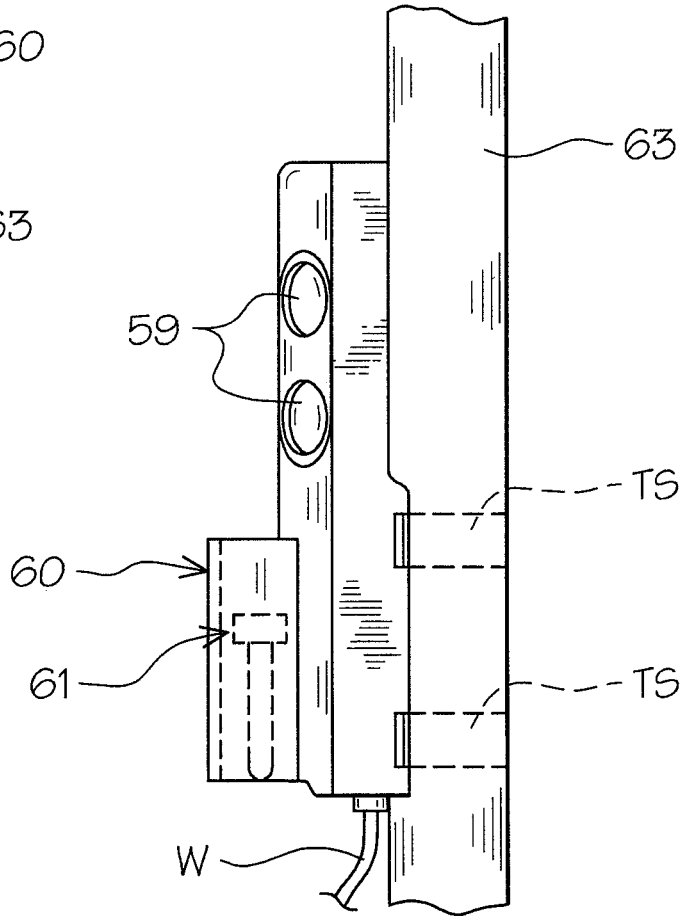
FIG. 15 is a side elevational view thereof.

Referring now to FIGS. 14 and 15 of the drawings, a third alternate control safety signal activation switch 58 can be seen having multiple signal buttons 59 with an integrated dead man switch 60 within a recessed housing portion 61. The signal request buttons 59 are independently directed to specific requests for "more sand", "less sand", "choke" and "air only" respectively in groupings.

A set apart recessed emergency button 62 is provided, as best seen in FIG. 14 of the drawings which will provide the ability of the operator to indicate an emergency situation which will be reflected in the display, as will be described hereinafter.

The alternate safety signal activation switch 58 is selectively mounted on a sandblast nozzle supply hose 63 as in prior alternate switch configurations 18, 41 and 50 by retainment straps TS.

It will be evident that the signaling switch 50 in electrical communication with an alternate expanded multiple light and alarm display 65, as seen in FIG. 12 of the drawings, as in the primary example by control wires W.

The signal light and alarm display 65 has multiple sets of signal and alarm lights 66 aligned for each of the separate multiple remote blast signal switches 58, in this example, which are accessed by ports 67 located at the bottom portion of the alarm display 65. Each of the access ports 67 allow an individual signal switch 58 to be connected and access the display assembly.

The light and alarm display 65 has multiple lights for each nozzle operator signal switch 58 that indicate thereby a need for blast pot operator action. The individual light actuation sequence illumination, chosen for illustration in this example, is as follows in a vertical display format.

An emergency display light 66A, a "more sand" display light 66B, a "less sand" display light 66C, and a "choke" display light 66D.

An "air only" button 66 is provided, all of which are in alignment with the appropriate access port 67 for the corresponding operator signal switch, as described.

A display light cancel button 68 is also provided for each of the respective multiple control light and button sets which will turn off the illuminated light within that set indicating that the blast post operator PO, illustrated in broken lines in FIG. 11 of the drawings has seen and acknowledged the blast operator 56 request inputted by the remote signal switch 58, as hereinbefore described.

It will also be evident that an emergency button 69 is provided for each of the signal light and button sets providing the operator the option to communicate with the blast operator that an emergency has occurred.

Additionally, the light alarm display 65 is equipped with a line continuity confirmation testing system with corresponding ready lights 72 in each of the light display sets that respond to a circuit test on each of the respective signal switches assuring that they are active and ready for use.

A notification of signal received to the light alarm signal display 65 is confirmed by an alarm light assembly 73 which alerts the operator of an incoming signal and is indicated by an LE strip which extends around the perimeter of the display face, in this example.

Further notification is achieved by an audio output alarm AA that is provided so that any communication from the blast nozzle operator 56 through the hereinbefore described signal switches in any of the multiple ports will activate the display indicating generally to the blast pot operator that a signal request has been made which can then be confirmed by reviewing the status of the above referred to and described light within the display sets to indicate what action is required and has been requested by which specific blast nozzle operator.

Additionally, a remote signal warning light 74 is illustrated in FIGS. 11 and 12 of the drawings will allow for remote positioning of the warning lights 74 to the primary light alarm panel 65 and proving again the usability in different use requirement situations.

Given that in many applications the operator signal switch 58 is inclusive of a dead man switch 60, it will be evident that an independent control cable corresponding to each one of the specific operator signal switches extends from the light alarm signal display 65 back to the sand pot assemblies SPA so that if the dead man switch is not maintained in its operational position as previously described, the system will shut down, as designed.

In operation, the blast nozzle operator 56 must hold down the specific activation signal button 59, in this example, for at least two to six seconds to activate the appropriate remote signal light display as noted. This eliminates accidental or unintentional activation of a requested operation since a deliberate pressing and holding the button must be achieved to initiate a signal light activation. As noted, all of the operator signal switches are connected to the light alarm signal display by wires W, but a wireless system WS can also be utilized which will provide wireless communication between the display 65 and the specific signal switch indicated in FIG. 11 of the drawings. A line splitter S, as illustrated in FIG. 11 of the drawings, may provide separate independent control line for the dead man switch back to the light alarm display 65, as hereinbefore described.

Additionally, the light and alarm display 65 may have a wi-fi WF activation cell phone application communication module that can alert through a specific app the blast operator's cell phone 75.

Additionally, the light and alarm display 65 may have a wi-fi WF activated cell phone app communication module that can alert through a specific app the blast post operator's cell phone 75 alerting them that a request has been made in the event that the operator is not in the adjacent area of the signal light display 65 to hear the audible signal or see the flashing light display as hereinbefore described.

The light and alarm signal display panel 65, as noted in prior display, may be powered by internal batteries B, rechargeable cells or have a power inlet PI adapter for onsite power (110 VC AC), if available. Concurrently the remote control signaling switch 58 may be self-powered with an onboard batter power, a rechargeable cell or power may be provided through the communication wire W if applicable.

The remote signal switch 58 is secured to the blast supply line 43 by conventional means, such as flexible tie straps TS, see in this example in broken lines in FIG. 15 of the drawings. Accordingly, the light and alarm signal display 65 may be secured to the blast supply equipment or adjacent thereto by fasteners such as magnetic or otherwise illustrated as F in broken lines in FIG. 12 of the drawings.

Figure 13:
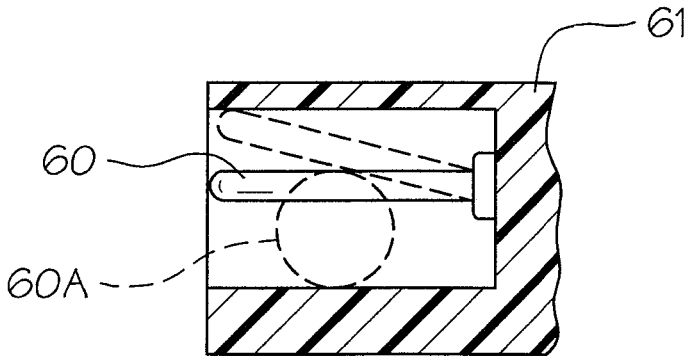
FIG. 13 is an enlarged partial cross-sectional view of the operation activation switch dead man switch.

Referring now to FIG. 13 of the drawings, the positioning retainment (holding) of a hooded dead man switch 61 can be seen where an insert 68 is used to wedge the dead man switch arms 60 to an activation position in broken lines, if removed the dead man switch armor turns to an off neutral position indicated by solid lines.

It will be evident that in this application, the dead man can be used to affect direct air and sand control also. In that application by pushing down, air only is applied and sand is shut off acting like a choke signal command as hereinbefore described.

Referring back to the FIGS. 11 and 12 of the drawings, voice communication system indicator lights 75 on the display panel 65 provide notification to the equipment operator that a blast operator 56 is requesting, in this example, direct communication through a wireless and/or wired two-way audio mike and transmitter which may be located in a blast hood 76 as is currently available and known within the art.

Blast operator button activation sequence for the remote signal switch 58 will also illuminate the corresponding request button on the signal switch as well as activate the alert's display 73 on the display panel 65 inclusive of audio alarms and other auxiliary alarm notification that may be employed as hereinbefore described.

It will thus be seen that a new and novel safety communication system and alternate forms for remote sandblasting operations has been illustrated and described and it will be apparent to those skilled in the art that various changes and modifications may be made thereto without departing from the spirit of the invention.

Therefore, I claim:

1. A safety communication system for sandblasting operations, said sandblasting operations having sandblasting equipment comprising:

a sandblast nozzle, a supply of sand and air under pressure, and a supply hose between said sand supply and said nozzle;

said safety communication system comprising:

a remote switch assembly at said sandblast nozzle, a signal light display and alarm in communication with said remote switch assembly and said sand and air supply;

said remote switch assembly comprising: multiple signal activation buttons and an emergency button;

said signal light display and alarm comprising: multiple illuminated elements and an audio alarm, said multiple illuminated elements and said audio alarm activated in response to signals from said remote switch assembly;

a cancel confirmation switch and a continuity confirmation indicator for each of said remote switch assemblies; and means for securing said signal light display to said sandblasting equipment.

2. The safety communication system for a sandblasting operation set forth in claim 1 wherein said remote switch assembly and said signal light display are interconnected with one another by a communications cable.

3. The safety communication system for a sandblasting operation set forth in claim 1 wherein said remote switch assembly and said signal light display are in communication with one another by wireless transmitter and receiver.

4. The safety communication system for a sandblasting operation set forth in claim 1 including means for remotely securing said signal light display and alarm, said means comprises a magnet on said signal light and display.

5. The safety communication system for a sandblasting operation set forth in claim 1 wherein said remote switch assembly further comprises an integrated dead man switch.

6. The safety communication system for a sandblasting operation set forth in claim 1 wherein said signal light display and alarm further comprises:

multiple duplicate sets of signal lights in communication with multiple independent remote switch assemblies, a communication connection port for each of said respective signal light sets and an emergency light in each of said signal light sets and a single cancel configuration button, a remote central alarm light in communication and activation from said multiple independent remote switch assemblies.

7. The safety communication system for a sandblasting operation set forth in claim 1 wherein said multiple illuminated elements indicate sand supply increase, sand supply decrease, and stopping airflow.

8. The safety communication system for a sandblasting operation set forth in claim 1 wherein said multiple illuminated elements comprise: indicia symbols and colored illumination.

9. The safety communication system for a sandblasting operation set forth in claim 1 wherein said signal light display and alarm further comprises, a remotely positioned alarm light and audio device in communication with said remote switch assembly.

10. The safety communication system for a sandblasting operation set forth in claim 1 wherein said signal light display has an independent alarm indicator for the remote switch assembly.

11. The safety communication system for a sandblasting operation set forth in claim 1 wherein said safety communication system further comprises: communication activation indicators for direct voice communication between a remote switch operator and a sandblasting equipment operator.

* * * * *